United States Patent [19]

Koterasawa

[11] Patent Number: 4,926,109

[45] Date of Patent: May 15, 1990

[54] LOW DROPOUT VOLTAGE REGULATOR WITH LOW COMMON CURRENT

[75] Inventor: Matsuro Koterasawa, Osaka, Japan

[73] Assignee: National Semiconductor Corporation, Santa Clara, Calif.

[21] Appl. No.: 369,421

[22] Filed: Jun. 21, 1989

[51] Int. Cl.[5] ..... G05F 1/59

[52] U.S. Cl. ..... 323/274; 323/268; 323/273

[58] Field of Search ..... 323/268, 269, 273, 274, 323/280

[56] References Cited

U.S. PATENT DOCUMENTS

| | | | |
|---|---|---|---|
| 3,261,980 | 7/1966 | McCartney et al. | 323/273 |
| 3,414,802 | 12/1968 | Harrigan et al. | 323/273 |
| 3,541,425 | 11/1970 | Weidmann | 323/273 |
| 4,042,886 | 8/1977 | Hanna | 323/280 |
| 4,441,070 | 4/1984 | Davies et al. | 323/268 |
| 4,613,809 | 9/1986 | Skovmand | 323/268 |
| 4,792,747 | 12/1988 | Schroeder | 323/274 |

*Primary Examiner*—Patrick R. Salce
*Assistant Examiner*—Jeffrey Sterrett
*Attorney, Agent, or Firm*—Gail W. Woodward; Lee Patch; Michael A. Glenn

[57] ABSTRACT

A circuit is shown in which a voltage regulator has an output stage that operates as a Darlington when the input-output differential exceeds a threshold. The circuit automatically switches to a common emitter output and an emitter-follower driver when the differential falls below the threshold. A current limiter prevents excessive common current when the output transistor is saturated.

5 Claims, 1 Drawing Sheet

LOW DROPOUT VOLTAGE REGULATOR WITH LOW COMMON CURRENT

BACKGROUND OF THE INVENTION

In a voltage regulator circuit the dropout voltage is defined as the input-output voltage differential at which the circuit ceases to regulate against further reductions in input voltage. Common current is that part of the input current to the regulator that is not delivered to the load.

FIG. 1 shows a conventional negative voltage regulator circuit. Terminal 10 is the input terminal to which a source of unregulated negative voltage is applied. The input is referenced to ground which is the common terminal. While this application will show a negative voltage regulator, and the preferred embodiment will be a negative regulator, the circuit and concepts developed will apply equally to positive regulators. Here the same circuits will be employed, but all of the devices would be complemented along with the polarity reversal.

Terminal 11 is the regulated negative output. The circuit controls the conduction in transistor 12 so that the output voltage is at the correct level regardless of input voltage or the output current in a load (not shown) connected between terminal 11 and ground. Driver transistor 13 operates with transistor 12 in a Darlington configuration. Transistor 14 acts as an emitter follower control amplifier that operates the Darlington. Differential amplifier (diff-amp) 15 drives control transistor 14 and has an inverting input connected to a source of constant reference voltage 16. This will typically be a voltage reference of well known construction that develops a potential that does not vary with changes in input voltage or temperature. The noninverting input of diff-amp 15 is coupled to a tap on voltage divider 17 which is coupled between output terminal 11 and ground. In operation diff-amp 15 will drive transistors 14, 13 and 12 to produce a potential at terminal 11 that will result in equality of the potentials into diff-amp 15. Accordingly, the output voltage at terminal 11 is established in part by the ratio of resistors 17*a* and 17*b*. Since the Darlington transistor is coupled as an inverter, the feedback loop is negative and of high gain so that the potential at terminal 11 is regulated and very stable.

The voltage regulator of FIG. 1 is very useful, but its dropout voltage is limited to the $V_{BE}$ of transistor 12 plus the $V_{SAT}$ of transistor 13. At 300° K. this is typically about a volt. Over temperature it can rise to about 1.2 volts. If lower dropout is desired, transistor 13 can have its collector returned to ground thereby converting the Darlington to an emitter follower driven common emitter transistor. This configuration will display a dropout voltage of $V_{SAT}$ which is only a small fraction of a volt over temperature. However, in such a configuration, the current flowing in transistor 13 will increase the regulator common current and is therefore undesirable.

SUMMARY OF THE INVENTION

It is an object of the invention to provide a voltage regulator having low dropout voltage and low common current.

It is a further object of the invention to sense the voltage regulator input-output differential and to switch the output stage from Darlington to emitter-follower drives as dropout is approached.

It is a still further object of the invention to switch the output stage of a voltage regulator from Darlington to emitter-follower driver as dropout is approached and to limit the common current at dropout.

These and other objects are achieved using the following circuit configuration. An output transistor has its emitter-collector electrodes coupled between the regulator input-output terminals and its base is coupled to the emitter of a driver transistor. The collector of the driver is coupled to the output terminal by means of a diode or to the common terminal by means of a controlled current path. The input to the controlled current path includes a switching transistor which has its emitter coupled to a diode plus constant current combination that returns the emitter to the input terminal 10. Another diode which has one terminal coupled to the same constant current element has its other terminal coupled to the collector of the driver transistor. Thus, depending upon the voltage across the output transistor the constant current will flow either in the diode coupled between the output terminal and the driver collector or in the input of the controlled current path. In the former state the driver will be Darlington configured with the output transistor and in the latter state the driver transistor will be in the emitter follower configuration. In addition, a current limiting transistor has its emitter coupled via a diode to the output terminal, its base coupled to the driver transistor base and its collector coupled to the diffamp output. In dropout the current limiting transistor conducts thereby lowering the diff-amp output which will limit the common current magnitude.

DESCRIPTION OF THE INVENTION

Figure 1:
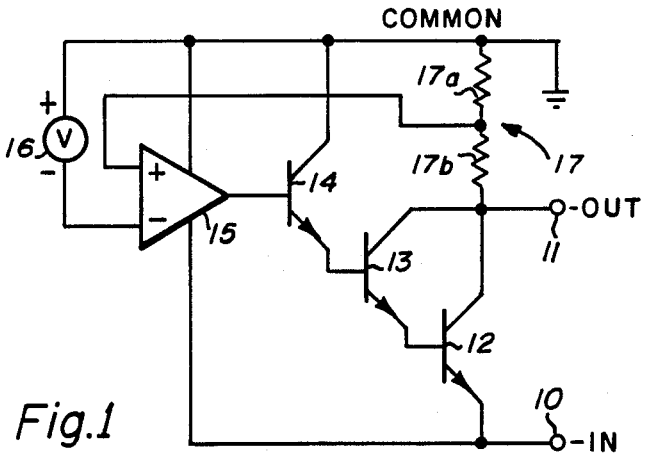
FIG. 1 is a schematic diagram of a conventional negative voltage regulator.
Figure 2:
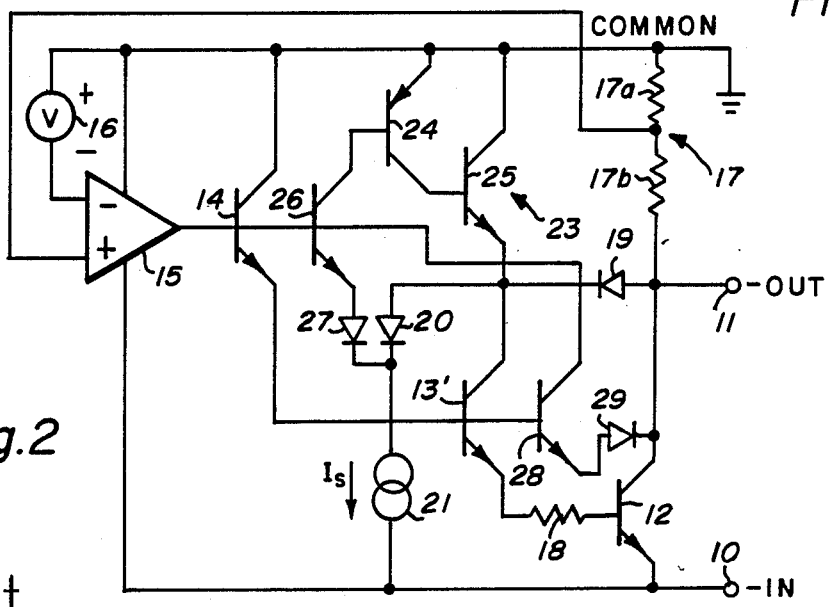
FIG. 2 is a schematic diagram of the circuit of the invention.

In the schematic diagram of FIG. 2 the invention is shown. A number of elements carry the same designations as those of FIG. 1. These elements perform similar functions. For example, transistor 12 is the output transistor. Any current flowing in a load (not shown) connected between terminal 11 and ground will flow mainly in transistor 12. Transistor 13' is the driver for transistor 12 and resistor 18 acts to limit the base current in transistor 12. Typically, resistor 18 will have a value of about 40 ohms.

Diode 19 couples the collector of transistor 13' to output terminal 11. When diode 19 conducts driver 13' will be Darlington connected to transistor 12. This will be the case when the input-output potential difference is large. The large differential will force Is in constant current source 21 to flow entirely in diode 20. This will turn diode 19 on and will turn diode 27 off. Typically, Is will be about 60 microamperes and will represent a relatively small percentage of the current flowing in diode 19. Under these conditions it can be seen that the output of diffamp 15 will be close to three diodes above terminal 10. If terminal 11 is about 5 volts above terminal 10, the collector of transistor 13' will be about one diode below this 5 volts. This will raise the juncture of diode 27 and current source 21 sufficiently to turn off diode 27. Thus, no current will flow in transistor 26 and transistors 24 and 25 will be off. This means that controlled current path 23 will be nonconductive.

As the input-output differential is reduced the potential at the collector of transistor 13' will be reduced. When this difference is at about 2.5 volts both diodes 20 and 27 will conduct about equally. Thus, $I_S/2$ will flow in diodes 20 and 27. The same value will flow in transistor 26. This will pull the base of transistor 24 low thereby turning it on. This in turn will pull the base of transistor 25 up and turn it on. Thus, controlled current path 23 will source current into transistor 13'. As the input-output differential lowers further diode 19 will turn off and controlled current path 23 will source more current into transistor 13'. In this mode the circuit will operate as if transistor 13' has its collector returned to ground and it acts as an emitter follower to drive transister 12. Accordingly, transistor 12 will tend to saturate and output terminal 11 can be pulled down to $V_{SAT}$ above $V_{IN}$. This is a small fraction of a volt at 300° K. (ordinarily about 0.1 volt at a current of 100 ma).

The above reduced saturation voltage is achieved by the action of transistor 13' acting as an emitter follower. Thus, the current flowing therein is no longer load current, but is a common current. Transistor 28 and diode 29 are present to limit the common current as the input-output differential decreases to its lowest value. The base of transistor 28 is at the same potential as the base of transistor 13'. Its collector is returned to the output of diff-amp 15 and its emitter is returned to output terminal 11 by way of diode 29. When output terminal 11 is pulled down to where it is two diodes below the potential at the base of transistor 13', transistor 28 will turn on and pull the base of transistor 14 down thereby limiting any further fall in potential at terminal 11 and any further rise in common current.

Figure 3:
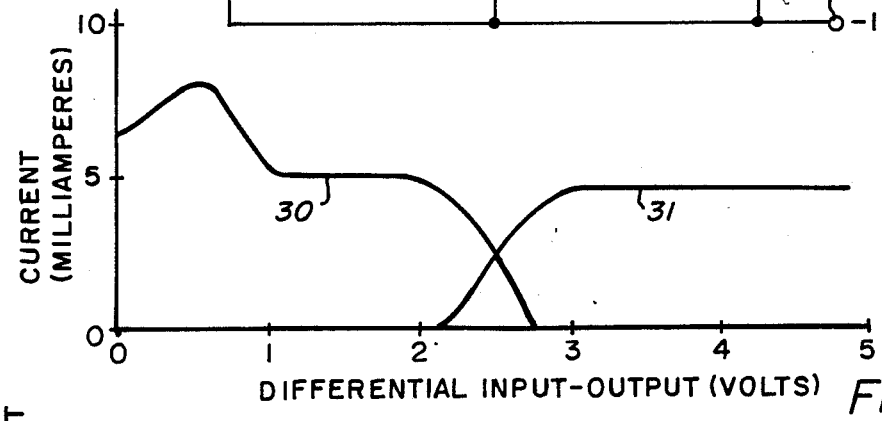
FIG. 3 is a graph showing the currents flowing in specific elements as a function of the input-output differential voltage.

With regard to FIG. 3, curve 30 shows a plot of conduction in transistor 25 as a function of input-output differential. Curve 31 shows the conduction of diode 19. At the lower voltages the conduction in transistor 25 dominates. The graph shows that conduction in transistor 25 starts when the input-output differential falls to about 2.75 volts. At two volts about 5 ma will flow and this rises to about 7.5 ma when the differential falls to about 0.5 volt. If transistor 28 and diode 29 were not in the circuit curve 30 would continue to rise as the differential is further lowered. Thus, a common current limiting action is evident in curve 30 of FIG. 3.

Curve 31 of FIG. 3 shows the current in diode 19. This current starts to flow when the input-output differential exceeds about 2.25 volts. When the differential exceeds about 2.75 volts the current in diode 19 levels off at just below 5 ma. However, this current will flow in any load (not shown) that is connected to terminal 11 and is not common current.

Figure 4:
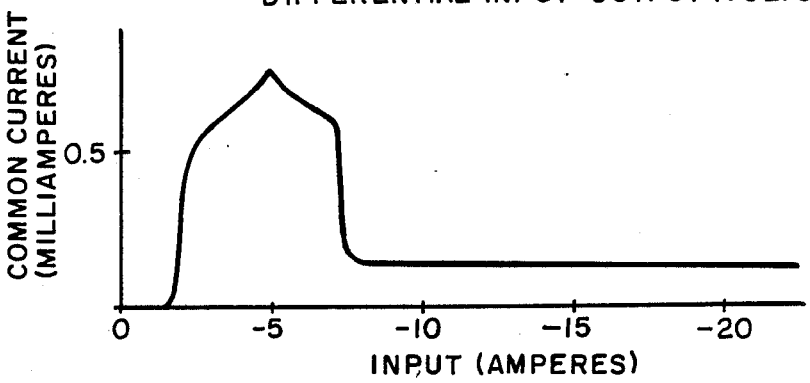
FIG. 4 is a graph showing common current as a function of input voltage for a five-volt regulator.

FIG. 4 is a curve of common current for a negative 5-volt regulator supplying one ampere output and wherein the output transistor junction temperature is maintained at 25° C. by means of heat sinking. The curve plots common current versus input voltage. Above about 7.5 volts input the common current levels off at about 1 ma. This is the combined currents of diff-amp 15, the current in voltage divider 17 and the combined currents in transistors 14, 24 and 25. It can be seen that as the input is reduced the common current rises to about 7.5 ma at about 5 volts and quickly falls to zero at about 2 volts.

Figure 5:
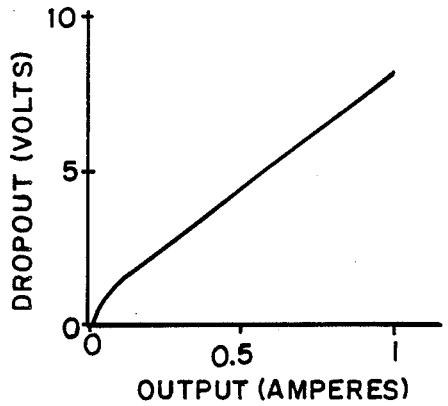
FIG. 5 is a graph showing dropout voltage as a function of current for a five-volt regulator.

FIG. 5 is a graph showing the relationship between dropout voltage and output current for the device of FIG. 4. It can be seen that at one ampere the dropout is well under a volt and is slightly over 0.1 volt at 100 ma.

EXAMPLE

The circuit of FIG. 2 was fabricated in conventional monolithic-silicon P-N-junction-isolated IC form. Resistors 17*a* and 17*b* were selected so that the output at terminal 11 was −5 volts. The data presented in FIGS. 3 through were obtained from the resulting IC's. The circuit function cross-over was about 2.5 volts as shown in FIG. 3. The common current showed a 7.5 ma peak at about −5 volts input as shown in FIG. 5 and the value leveled off at about 1 milliampere above about −7.5 volts input. The dropout voltage was less than one volt for a one ampere output over a temperature range of −40° C. to +125° C.

The invention has been described and a working example detailed. When a person skilled in the art reads the foregoing description, alternatives and equivalents, within the spirit and intent of the invention, will be apparent. Accordingly, it is intended that the scope of the invention be defined only by the following claims.

I claim:

1. A voltage regulator circuit having a common terminal, an input terminal for receiving an unregulated voltage, and an output terminal for supplying a regulated output voltage, said circuit comprising:

output transistor means having a base and having its collector-emitter electrodes connected between said input and output terminals;

driver transistor means having a transistor emitter coupled to said base of said output transistor and having collector and base electrodes;

control transistor means having a transistor emitter coupled to said base of said driver transistor, a collector returned to said common terminal and a base electrode by which said control transistor means operates as an emitter follower;

means, responsive to the potential across said output transistor, for switching the collector of said driver transistor to either said output terminal when said potential is below a predetermined value or to said common terminal when said potential exceeds said predetermined value.

2. The circuit of claim 1 wherein said collector of said driver transistor is coupled by means of a first diode to said output terminal or to said common terminal by means of a controlled current path wherein said means for switching controls the conduction in said first diode and said controlled current path.

3. The circuit of claim 2 wherein said means for switching comprise second and third diodes commonly coupled via a constant current path to said input terminal and individually coupled to said collector of said driver transistor and to the input of said controlled current path.

4. The circuit of claim 1 further comprising a differential amplifier having an output coupled to said base of control transistor means, an inverting input coupled to a source of reference potential and a non-inverting input coupled to the tap on a voltage divider coupled between said output and said common terminals whereby the voltage at said output terminal is determined to a first order by said voltage divider.

5. The circuit of claim 4 further comprising limiting transistor means having a transistor base coupled to said base of said driver transistor, a collector coupled to said base of said control transistor means and an emitter coupled by way of a fourth diode to said output terminal whereby, when said output transistor goes into saturation, said limiting transistor means conducts and pulls the base of said control transistor towards the collector of said output transistor.

* * * * *